United States Patent [19]

Baggott

[11] Patent Number: 4,959,763

[45] Date of Patent: Sep. 25, 1990

[54] DISPLAY FRAME SYSTEM

[75] Inventor: George T. Baggott, Cleveland, Ohio

[73] Assignee: Import-Export, Research & Development, Inc., Cleveland, Ohio

[21] Appl. No.: 354,628

[22] Filed: May 19, 1989

[51] Int. Cl.[5] ..... G09F 7/00

[52] U.S. Cl. ..... 362/382; 40/605; 40/610; 40/611; 248/165

[58] Field of Search ..... 362/382; 40/605, 610, 40/611; 248/165

[56] References Cited

U.S. PATENT DOCUMENTS

| | | | |
|---|---|---|---|
| 3,307,280 | 3/1967 | Mazur | 40/605 X |
| 3,449,848 | 6/1969 | Howell | 40/605 |
| 4,214,392 | 7/1980 | Virsen | 40/605 |
| 4,604,820 | 8/1986 | Edman | 40/605 |

*Primary Examiner*—Allen M. Ostrager

*Attorney, Agent, or Firm*—Renner, Otto, Boisselle & Sklar

[57] ABSTRACT

A display frame system comprises hexagonal or octagonal posts and strut assemblies which connect the posts to each other. The posts may be positioned in any of a variety of arrangements depending upon the available space and type of display to be erected. Once the posts have been connected to each other, panels carrying advertising material may be slipped into slots in the posts. The posts are arranged so that each post has a slot which faces a corresponding slot on an adjacent post. Opposite edges of the advertising material are received in the slots in each posts. The display frame system also includes a variety of illumination panels. These are panels which are also mounted between opposing slots in the posts and which carry light fixtures which can either illuminate advertising material from behind or from above, depending upon the configuration of the illumination panel and the arrangement of the posts. The strut assemblies which connect the posts to each other are fastened to the tops and the bottoms of the posts. The strut assemblies include struts which are hidden from view behind the front face of the panel carrying advertising materials. To this end the offset struts include a central portion which is straight and generally parallel to the plane of the panel and two angled end portions which extends to the center of the post. Where the posts are octagonal, the angled end portions are at a 45° angle to the central portion of the offset strut.

15 Claims, 7 Drawing Sheets

DISPLAY FRAME SYSTEM

FIELD OF THE INVENTION

The present invention relates to display stands or exhibit booths of the type used at conventions or trade shows.

FIELD OF THE INVENTION

At trade shows or conventions it is frequently necessary to set up a display for a day or two and then to disassemble and remove the display when the show is over. Such a display must therefore be readily assembled and disassembled. Further it is desirable for the display to be as compact as possible for shipping when disassembled. In order to accommodate different physical layouts that are encountered at different trade shows, the display should easily permit rearrangement of its various parts. It should also be possible to readily substitute new advertising materials. All of this should be accomplished with components that are attractive to potential customers.

SUMMARY OF THE INVENTION

The present invention provides a system of posts and strut assemblies which together make a frame unit. The frame unit supports a variety of advertising materials and accessories. The posts include lengthwise slots facing each other so that panels of advertising material can be supported by being slid into the slots. A frame unit can be arranged in a variety of ways. In one arrangement the posts in plan view define a right isosceles triangle. Panels of advertising may be placed between any or all of the posts by sliding them into the slots in the posts. Where two of the panels have advertising on their outside surfaces, the third panel may include a light fixture mounted on its inside surface. This light serves to backlight the advertising. In another variation of the right isosceles triangle, two panels may have advertising on their inside surfaces with the hypotenuse being left open. A light fixture may be mounted across the top of the posts along the hypotenuse. This light fixture provides light which is reflected off of the advertising material and may also be shielded from direct view by a header panel containing advertising which is backlit by the same light.

A number of frame units may be joined together to form displays of varying shapes. For example, a fourth post may be added to the right isosceles arrangement to form a square pillar. Successive posts may be joined in a zigzag pattern. This flexibility is attractively achieved by using posts with an octagonal cross-section and a slot running the length of each face of each post. The posts are arranged so that each has a slot which is parallel to and faces a corresponding slot in another post. Struts connect each post at its top and bottom to its neighbor, keeping them in proper alignment. The struts may be entirely straight or may have angled end portions. The struts with angled end portions extend behind the plane defined by the panel-receiving slots and thus are invisible once the display is assembled.

The invention then comprises the features hereinafter described and particularly pointed out in the claims, the following description and annexed drawings setting forth in detail illustrative embodiments of the invention, these being indicative of but a few of the various ways in which the invention may be embodied.

DESCRIPTION OF PREFERRED EMBODIMENTS

Figure 1:
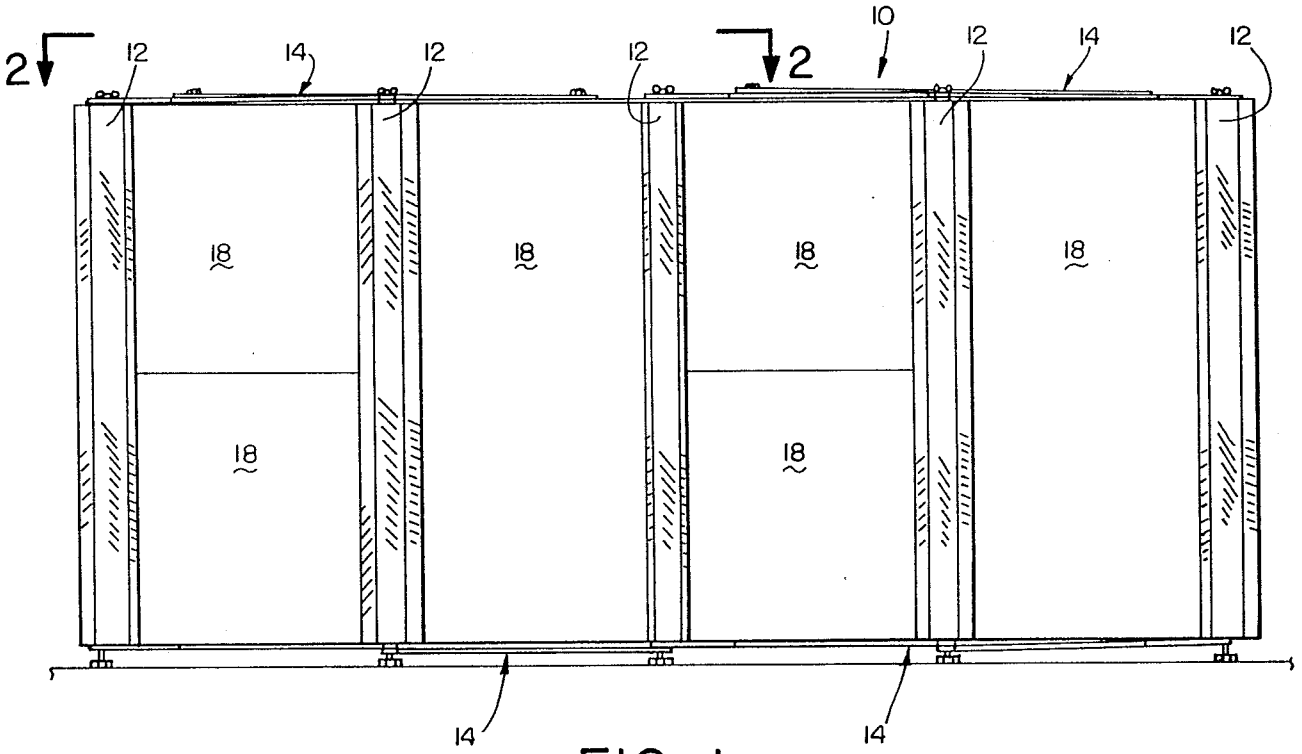
FIG. 1 is a front elevation view of a display constructed from a number of display frame units of the present invention.

FIG. 1 illustrates a display 10 for use at a convention, trade show, or the like. The display 10 is assembled from posts 12 connected to each other top and bottom by strut assemblies 14. Panels 18 which may carry advertising material fit between the posts 12 as is described below. The display 10 may be readily assembled or disassembled from the various components and may be configured in various ways to suit the surroundings and circumstances.

Figure 2:
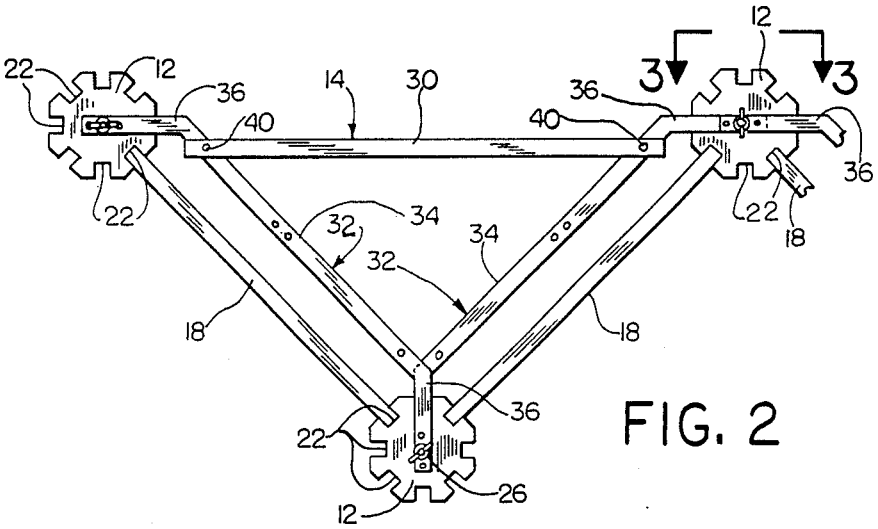
FIG. 2 is a plan view looking generally in the direction of arrows 2—2 of FIG. 1 illustrating three posts and a strut assembly arranged according to the present invention to provide a display frame for two panels.
Figure 4:
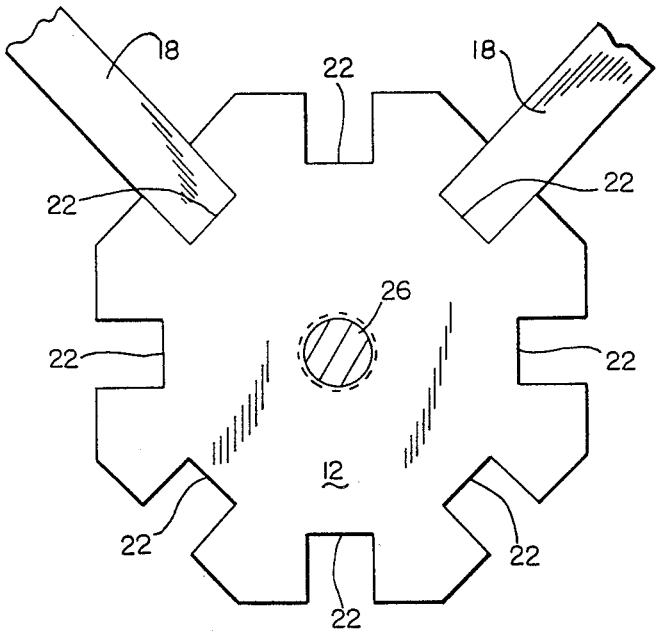
FIG. 4 is a plan view in the direction of arrows 4—4 in FIG. 3 showing the configuration of the posts of FIGS. 1 through 3.

The posts 12 are all identical and interchangeable. Each post 12 has an octagonal cross-section. As shown in FIGS. 2 and 4 each post 12 has rectangular slots 22 which extend the full length of each face of the post. The slots 22 are proportioned to receive the panels 18 and various lighting fixtures described below. In order to accommodate the panels 18, the posts 12 are positioned so that a slot 22 on one post faces a slot on another post. In this way the planar panels can be slid into the slots 22 and will be supported by them.

Strut assemblies 14 are fastened by suitable threaded fasteners to opposite ends of posts 12. A conventional metal nut 24 may be fastened in each end of the post 12 along the axial center line of the post. The nut 24 at the top of the post 12 receives a wing bolt 26 while the nut 24 at the bottom of the post 12 receives a threaded floor glide 28.

Figure 3:
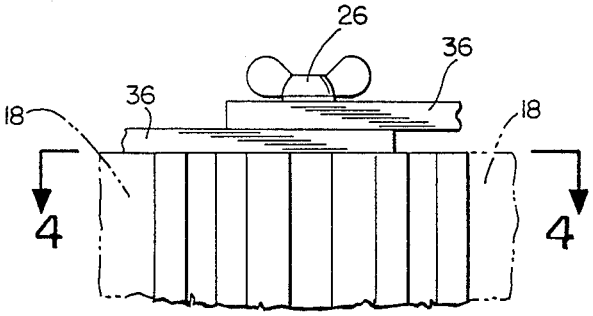
FIG. 3 is a view looking generally in the direction of arrows 3—3 of FIG. 2 and showing on an enlarged scale certain details of the assembly of FIG. 2.
Figure 3:
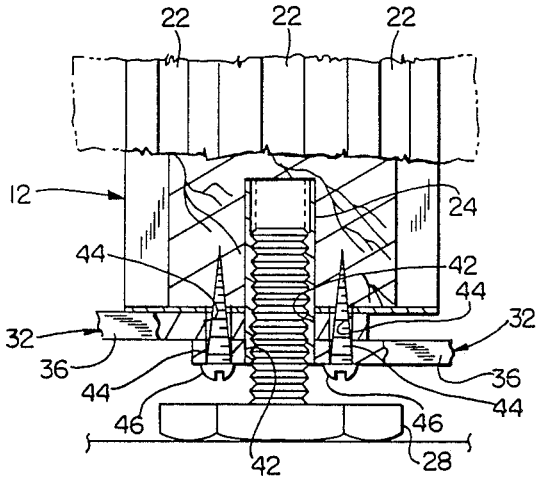

All of the struts in the strut assembly 14 are made of a rigid material such as aluminum bar stock approximately one inch by one-quarter inches in cross-section. The struts of strut assembly 14 have apertures 42 (FIG. 3) near their opposite ends to receive the wing bolts 26 or floor glide 28, respectively. When the wing bolts 26 at the tops of posts 12 are tightened, they clamp the offset struts tight against the top surface of the posts.

The strut assembly 14 (FIG. 2) includes two kinds of struts, a straight strut 30 and a pair of offset struts 32. The offset struts 32 include a straight central portion 34 and angled end portions 36. The angled end portions 36 are at a 45° angle to the axis of the central portions 34.

The angled end portions 36 provide several advantages. First, the offset struts 32 do not block access to any of the slots, 2,2 where panels will go. This permits panels to be inserted or removed after the strut assembly 14 has been connected to the posts 12. In addition, the central portion 34 of the offset strut 32 is parallel to but behind the panel 18, and so is out of sight. This presents a neater appearance to a prospective customer.

The offset struts 32 and straight struts 34 have holes 38 which permit the straight struts 30 and offset struts 32 to be connected to each other by suitable fasteners such as nuts and bolts 40. When straight strut 30, offset struts 32, and posts 12 are connected to each other as shown in FIG. 2, they take on the arrangement of a right isosceles triangle with the straight strut 30 being the hypotenuse.

At the bottom of post 12 (FIG. 3), the floor glide 28 fits through the aperture 42 in the angled end portion 36 of the offset struts 32. The floor glide cannot be used to hold the struts 32 tight against the bottom of the post 12 because the floor glide must be adjustable to accommodate uneven floor surfaces. Accordingly, two small holes 44 are made on diametrically opposite sides of the hole 42 through the angled end portion 36 of each offset strut 32. These holes 44 receive screws 46 which serve to hold the offset struts 32 tight against the bottom of post 12.

As an alternative to the screws 46, a large, knurled nut may be used. This nut may be threaded onto the shaft of the floor glide 28 and manually tightened to squeeze the offset brackets 32 against the bottom of the posts 12. Of course, this lock nut could only be tightened after the floor glide had been adjusted to level the display 10.

A plate 50 is mounted between the offset struts 32 and the bottom of post 12 in order to close the bottoms of the slots 22. This plate prevents panels 18 from sliding through the slots all the way to the floor. The plate 50 has an octagonal shape congruent with the cross-section of the post 12. It is formed with a hole through its center to accommodate the stud of the floor glide 28. The plate 50 has additional small holes aligned with the holes 44 through the offset struts to accommodate the screws 46. When a panel 18 is slid into a slot 22, the bottom of the panel rests on the top surface of the plate 50.

Figure 5:
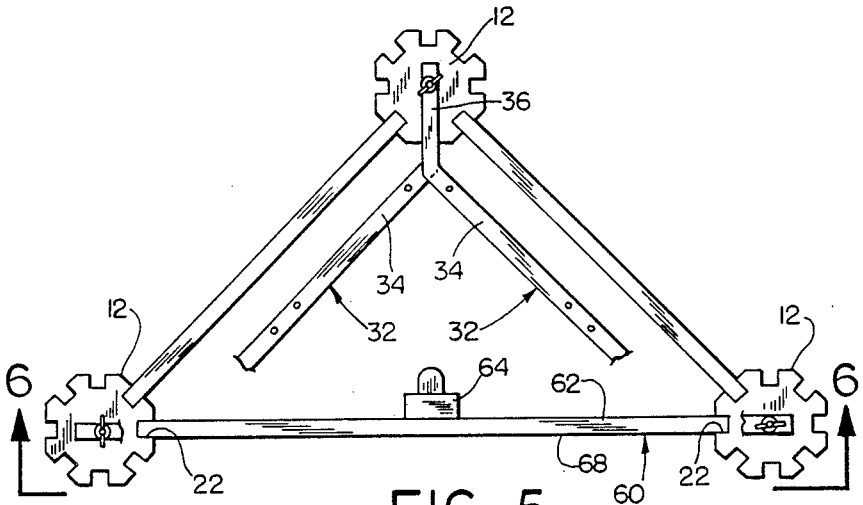
FIG. 5 is a partially cutaway plan view generally similar to FIG. 2 and illustrating an illumination panel constructed in accordance with the present invention.
Figure 6:
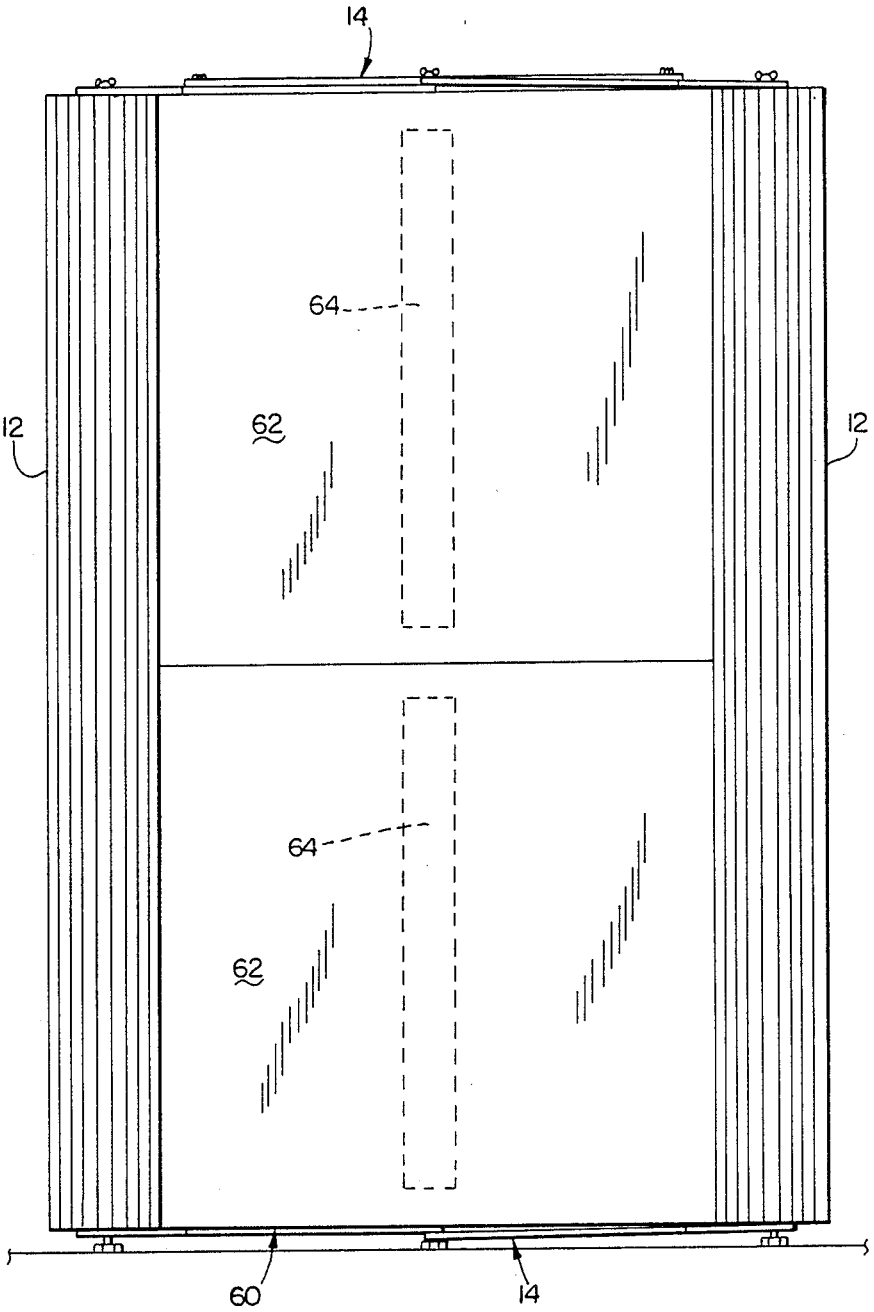
FIG. 6 is a view looking generally in the direction of arrows 6—6 of FIG. 5.

The posts 12 and strut assemblies 14 can accommodate a variety of light fixtures which can provide illumination either from behind or from above the panels 18. FIGS. 5 and 6 show an illumination panel 60 extending between two posts 12. The posts of FIG. 5 are arranged in the right isosceles arrangement discussed in connection with FIG. 2, and the illumination panels 60 span the hypotenuse of the triangle. At least one of the panels 18 is intended to be illuminated from behind and accordingly has translucent areas.

The illumination panels 60 include a generally planar board 62 which may be plywood, a suitable particle board, or sheet metal. The board 62 slides into a pair of slots 22 on the posts 12 which face each other. The board 62 may extend the full length of the post 12, but conveniently, and as illustrated in FIG. 6, two boards 62 are used. This facilitates shipping, storage, and handling of the illumination panel 60. The use of two boards 62 to mount two separate light fixtures 64 also permits the panels 18 to be divided horizontally with one portion being illuminated and the other not.

Each board 62 carries a light fixture 64 which may be a fluorescent light fixture as illustrated. However, different types of light fixtures could be used depending upon the advertising effect to be achieved. For example, the light fixtures could include incandescent bulbs of various colors or a single incandescent bulb with a disc rotating in front of it carrying different colored filters. More than one light fixture could be used.

Because the illumination panels 60 are received in slots 22 which are covered by the angled end portions 36 of the offset struts 32, it is necessary to insert the illumination panels 60 into the respective slots of the posts 12 before the wing bolts 26 tighten the strut assembly 14 into place. The board 62 may carry display material or advertising material on its outside surface 68, but it is generally contemplated that the outside surface 68 of the board 62 will be facing a non-public area or be against a wall.

Figure 7:
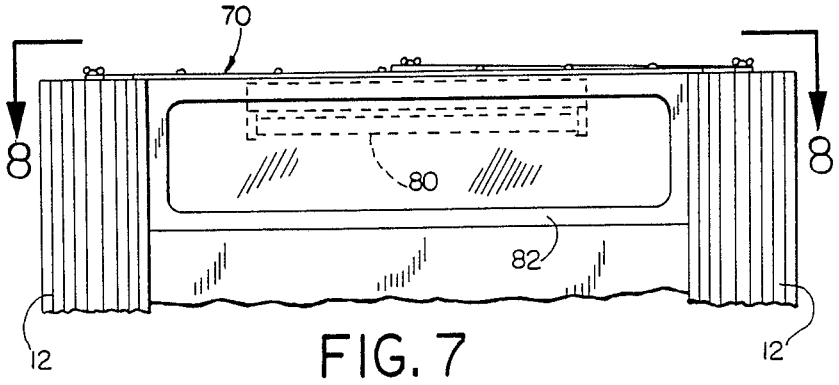
FIG. 7 is a front elevation view of a second form of illumination panel.
Figure 8:
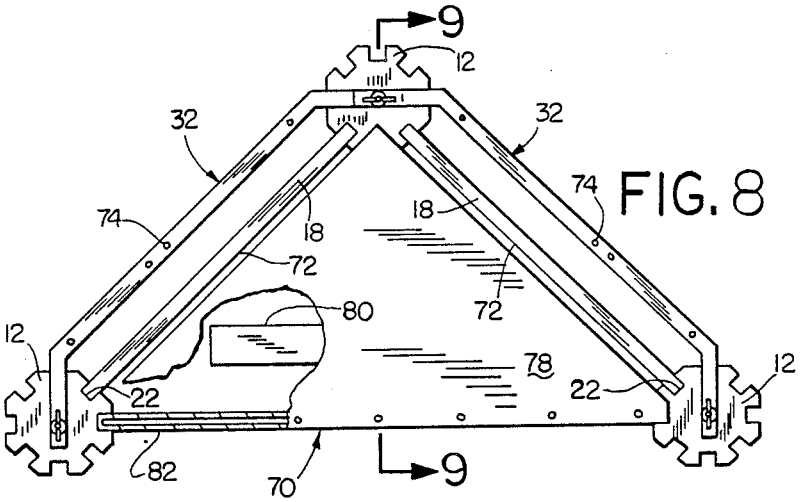
FIG. 8 is a partially sectioned view looking in the direction of arrows 8—8 of FIG. 7.
Figure 9:
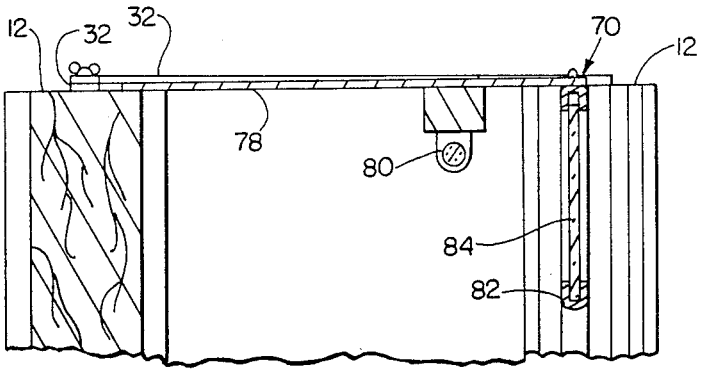
FIG. 9 is a view looking generally in the direction of arrows 9—9 of FIG. 8.

FIGS. 7 through 9 illustrate a second type of illumination panel 70 as well as a different arrangement of the posts 12 and offset struts 32. As illustrated in plan view in FIG. 8, the posts 12 and struts 32 are again arranged in right isosceles configuration. However, panels 18 have the advertising material printed on what may be termed their inside surfaces 72. In order that the offset struts 32 remain invisible, they are flipped over from the position shown in FIG. 2 so that the straight central portions 34 again are behind the panels 18. In order to provide triangulation to hold the posts 12 in a fixed position and to keep the angle between the plane of panels 18 at 90°, holes 74 are provided in the struts 32. These holes permit the strut 30 to be secured to the two struts 32 to make a rigid, determinate structure.

The light fixture 70 includes a triangular sheet 78 which is proportioned to rest on the tops of each of the posts 12 yet not interfere with any of the slots 22 in which the panels 18 are inserted. The sheet may be of any suitable material such as sheet metal, wood or particle board. A light fixture 80 is suspended from the bottom side of the sheet 78. The light fixture 80 provides light which is reflected off of the inside surface 72 of the panels 18. Again, light fixture 80 is shown as being a fluorescent fixture, but other types of light fixtures could be used.

The illumination panel 70 also includes a frame 82 which spans the hypotenuse of the right isosceles triangle defined by panels 18. The frame 82 slides into an opposed pair of slots 22 on the posts 12 and extends down the length of the posts only a short distance, perhaps 10 or 12 inches. The frame 82 is fastened to the triangular sheet 78 by rivets or any other suitable means.

The frame 82 carries a translucent sheet 84 which may have advertising material intended to be backlit on it. The frame 82 and translucent panel 84 thus serve to block the light fixture 80 from direct view, while light from that fixture backlights any signage mounted in the frame 82.

Figure 10:
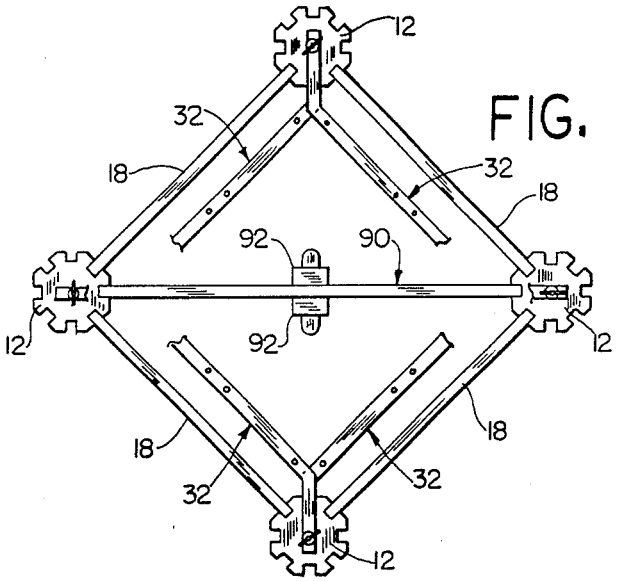
FIG. 10 is a plan view illustrating an arrangement of posts and strut assemblies which form a square kiosk having a diagonally positioned illumination panel with light fixtures on both sides.

FIG. 10 illustrates in plan view yet another arrangement of posts 12 and strut assemblies 14. In this case, a fourth post 12 has been added to the right isosceles arrangement of FIG. 2 so that the panels 18 form a square kiosk. Although not shown, at least one straight strut 30 is used to triangulate the structure and make it rigid.

In addition, an illumination panel 90 is shown in FIG. 10 which is generally similar to the illumination panel 60 of FIG. 6 except that the illumination panel 90 includes two light fixtures 92 located on opposite sides of the board 94. This arrangement permits backlighting of all the panels 12 shown in the square kiosk of FIG. 10.

Figure 11:
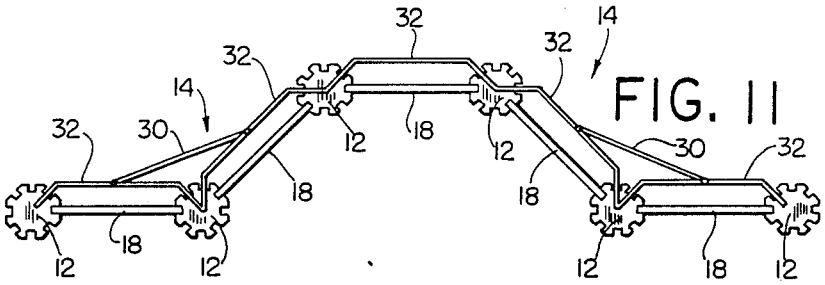
FIG. 11 is a schematic illustration of another arrangement of posts and strut assemblies.

FIG. 11 illustrates yet another arrangement of posts 12, panels 18, and strut assemblies 14. In this case, the angle included between adjacent panels 18 is 135° rather than 90°. Appropriate holes are bored in the offset struts 32 to permit the straight struts 30 to triangulate the structure and make it rigid and determinate.

Figure 12:
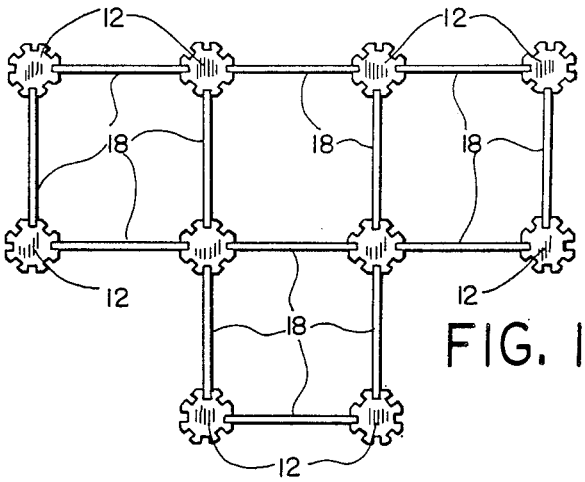
FIG. 12 is an illustration of another arrangement of posts, the strut assemblies not being shown for purposes of clarity.

FIG. 12 illustrates schematically yet another possible arrangement of posts and panels. The strut assemblies are not shown for purposes of clarity. Of course, the arrangements shown are but a few of the many arrangements which possible. The flexibility in choosing arrangements and the variety of illumination panels provides one of the distinct advantages of the present invention.

Figure 13:
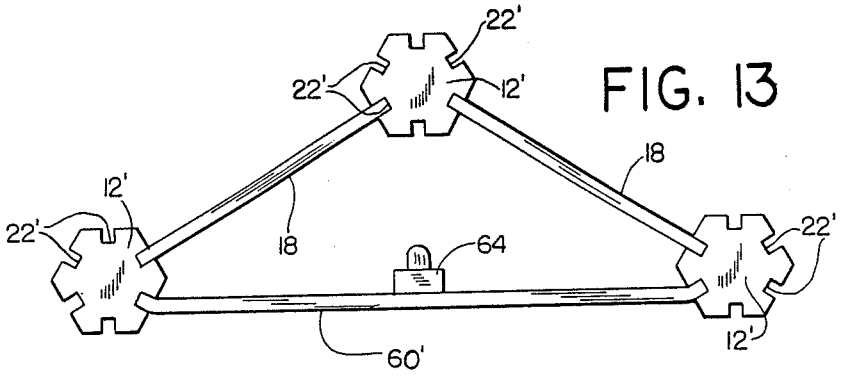
FIG. 13 is a plan view of a second embodiment of the present invention with the strut assemblies not being shown for purposes of clarity.

FIG. 13 illustrates yet another embodiment of the present invention, this time based on a hexagonal geometry rather than the octagonal geometry of FIGS. 1 through 12. For this reason parts in FIG. 13 are designated by the same reference numeral as similar parts in FIGS. 1–12 with ′ (prime) added. In the FIG. 13 embodiment the offset struts 32′ have their angled end portions 36′ at a 30° angle to the straight central portion 34′ rather than at a 45° angle as in FIGS. 1–13.

In the embodiment shown in FIG. 13, the illumination panel 60′ is generally similar to the illumination panel 60 of FIG. 5 except that its edges are angled at a 30° angle to accommodate the geometry of the posts 12′. Using hexagonal posts 12′, it is not conveniently possible to build a square kiosk as illustrated in FIG. 10, but a hexagonal kiosk could be assembled. In addition, an overhead illumination panel analogous to the illumination panel 70 could easily be fashioned.

In all of the embodiments described above, the slots 22 on the posts 12 which are not used to support panels 18 or illumination panels may be used to support other types of accessories. For example, strips of small decorative lights like Christmas tree lights may be fitted within any of the slots. In addition, display racks for literature may be mounted in the slots by means of conventional expanding fasteners.

What is claimed is:

1. A display frame unit for supporting panels with parallel opposite edges for display, the frame unit comprising three posts, a strut assembly for connecting the posts to each other, and fastener means for connecting the strut assembly to the ends of the posts;

pairs of posts including opposed, parallel slots for receiving the edge portions of a panel, the strut assembly including at least one offset strut extending between a pair of posts and having a central portion offset from a plane defined by the opposed pair of slots in said pair of posts.

2. The frame unit of claim 2 including a strut assembly at both the top and bottom ends of the posts.

3. The frame unit of claim 1 wherein the strut assembly includes a straight strut connected between two offset struts.

4. The frame unit of claim 3 wherein the offset struts each have a straight central portion, and end portions disposed at an angle to the straight portions.

5. The frame unit of claim 4 wherein the posts have octagonal cross-sections and each face of the post includes a lengthwise slot.

6. The frame unit of claim 1 further including an illumination panel, having edges adapted to be received in a pair of opposed parallel slots in the posts and illumination means secured to said panel.

7. The frame unit of claim 1 further including an illumination panel adapted to extend between opposed parallel slots in the posts, and including limit means for limiting movement in one direction of said illumination panel in the slots.

8. The frame unit of claim 7 wherein the limit means comprises surface means for contacting the ends of the posts.

9. The frame unit of claim 7 wherein the limit means includes a planar panel resting on top of each of the posts and the illumination panel further includes a light fixture connected with said planar panel.

10. The frame unit of claim 9 further including a diffusion panel mounted between the posts, the diffusion panel including a frame and a light diffusing translucent sheet mounted in the frame.

11. The frame unit of claim 10 wherein the diffusion panel extends less than the entire length of the slots.

12. A plurality of display frame units according to claim 2 each unit sharing at least one post in common.

13. The frame unit of claim 2 wherein the fastener means includes threaded fasteners coaxial with the axes of the posts and apertures in the end portions of the struts for receiving the threaded fasteners.

14. The frame unit of claim 3 wherein the straight strut is pivotally connected to the two struts.

15. The frame unit of claim 14 wherein the straight strut is pivotally connected to the central portion of each of the offset struts.

* * * * *